US011473282B2

(12) United States Patent
Momoe et al.

(10) Patent No.: US 11,473,282 B2
(45) Date of Patent: Oct. 18, 2022

(54) FLUSH TOILET

(71) Applicant: TOTO LTD., Kitakyushu (JP)

(72) Inventors: Masaaki Momoe, Kitakyushu (JP); Shu Kashirajima, Kitakyushu (JP)

(73) Assignee: TOTO LTD., Kitakyushu (JP)

( * ) Notice: Subject to any disclaimer, the term of this patent is extended or adjusted under 35 U.S.C. 154(b) by 76 days.

(21) Appl. No.: 17/025,883

(22) Filed: Sep. 18, 2020

(65) Prior Publication Data

US 2021/0095452 A1 Apr. 1, 2021

(30) Foreign Application Priority Data

Sep. 27, 2019 (JP) ..... JP2019-177893

(51) Int. Cl.
*E03D 5/01* (2006.01)
*E03D 1/26* (2006.01)

(52) U.S. Cl.
CPC *E03D 5/01* (2013.01); *E03D 1/26* (2013.01)

(58) Field of Classification Search
CPC ..... E03D 1/26; E03D 5/01; E03D 9/08
USPC ..... 4/331, 332
See application file for complete search history.

(56) References Cited

U.S. PATENT DOCUMENTS

2013/0291297 A1* 11/2013 Kitamura ..... E03D 11/08 4/422
2017/0089052 A1* 3/2017 Ishimaru ..... E03D 11/08

FOREIGN PATENT DOCUMENTS

| | | | |
|---|---|---|---|
| JP | 2003-201730 | A | 7/2003 |
| JP | 2009-2075 | A | 1/2009 |
| JP | 2010-203202 | A | 9/2010 |
| JP | 2013-28965 | A | 2/2013 |
| JP | 2019-44819 | A | 3/2019 |

OTHER PUBLICATIONS

Notice of Reasons for Refusal issued in Japanese Patent Application No. 2019-177893 dated Sep. 13, 2021, with English translation.

* cited by examiner

*Primary Examiner* — Christine J Skubinna
(74) *Attorney, Agent, or Firm* — BakerHostetler

(57) ABSTRACT

A flush toilet includes a toilet main body and a tank device, where the tank device includes a water supply part, a storage tank, a small tank, a pump, a float switch, and a controller, a collision part against which flush water that is supplied from the water supply part to the storage tank via the small tank collides is provided in the storage tank, and the collision part is formed to cause the flush water to fall onto a water surface on the float switch side in the storage tank after collision.

8 Claims, 7 Drawing Sheets

FLUSH TOILET

CROSS-REFERENCE TO RELATED APPLICATION

This application claims benefit of priority to Japanese Patent Application No. 2019-177893, filed Sep. 27, 2019, the entire content of which is incorporated herein by reference.

BACKGROUND

Technical Field

The present disclosure relates to a flush toilet, and more particularly, to a flush toilet for flushing and discharging waste with flush water.

Description of the Related Art

Conventionally, as a flush toilet for flushing and discharging waste with flush water, one including a ballcock that is provided inside a storage tank for storing flush water that is to be supplied to a toilet main body is known, as disclosed in Patent Document 1 (Japanese Patent Laid-Open No. 2019-44819), for example.

Such a conventional ballcock includes a valve body for opening/closing a water supply port for supplying water to the storage tank, a float mechanism for transmitting rise and fall of a water surface in the storage tank, and a lever mechanism for opening/closing the valve body according to the rise and fall of the water surface, the lever mechanism being connected to the float mechanism. Furthermore, the valve body includes means for deflecting a flow of supplied water, and suppresses rippling of the water surface in the storage tank caused by supplied water at the time of water supply and adjusts a water surface state in the storage tank.

Next, with a conventional flush toilet described in Patent Document 2 (Japanese Patent Laid-Open No. 2013-28965), a ballcock provided inside a storage tank includes an in-tank water discharge port and a make-up water discharge port.

Furthermore, the ballcock is provided with a water receiving member. The water receiving member may receive water discharged and falling from the make-up water discharge port, guide the water to outside an overflow pipe and cause the water to flow into the tank, and a water surface state in the storage tank may thereby be adjusted.

Furthermore, with a conventional flush toilet described in Patent Document 3 (Japanese Patent Laid-Open No. 2010-203202), a water receiving plate including a collision wall is provided in a storage tank, and flush water that is supplied from a water supply port inside the tank directly from a main water pipe is received by the water receiving plate after colliding against the collision wall. The water receiving plate includes a large number of drain holes for causing water that is retained inside to flow out and fall into the tank, and the sound of excretion of a user is cancelled and prevented from escaping outside, by a flowing sound of flush water flowing through the drain holes and a collision sound of the flush water colliding into the collision wall.

Furthermore, with a conventional flush toilet described in Patent Document 4 (Japanese Patent Laid-Open No. 2003-201730), a baffle is provided above a discharge valve for opening/closing a drain port of a storage tank, below a discharge port of a ballcock. Accordingly, flush water that is discharged from the discharge port of the ballcock is prevented by the baffle from falling directly onto the discharge valve, and thus, an opening operation of the discharge valve may be prevented from being obstructed by a water supply pressure.

With the conventional flush toilets described above, one big issue is how to control the flush water or the state of the water surface in the storage tank to achieve respective objects.

Furthermore, as another issue regarding control of the flush water or the state of the water surface in the storage tank, if water-level sensing means, such as a float switch including a sensing unit that moves up and down according to a storage tank water level, is adopted to detect a water level in the storage tank, an abnormal phenomenon called "chattering" whereby the sensing unit (a float or the like) subtly and repeatedly oscillates may occur depending on the degree of rippling of the water surface caused by water supply to the storage tank.

Particularly, when the sensing unit (a float or the like) of the float switch is not operated for a long time, water scale or the like may be deposited on the sensing unit, and malfunction may be caused.

Accordingly, how to maintain a state where there are no deposits on the sensing unit of the float switch at the time of operation of a tank device is an important issue from the standpoint of protecting the tank device.

Accordingly, the present disclosure provides a flush toilet, with which malfunctioning of a float switch may be prevented and reliability of the float switch may be increased.

SUMMARY

To solve the problems described above, the present disclosure is a flush toilet for flushing and discharging waste with flush water, the flush toilet comprising: a toilet main body including a bowl configured to receive waste, a rim portion formed on a top edge of the bowl, and a discharge trap configured to discharge the waste in the bowl; and a tank device configured to supply flush water to the toilet main body, the tank device being provided behind the toilet main body, wherein the tank device includes a water supply part configured to supply the flush water that is supplied from a water supply source, a storage tank main body provided behind the toilet main body, above a floor surface, a small tank that is communicably connected to an upper part of the storage tank main body and to which a water supply pipe of the water supply part is connected, a pump configured to feed the flush water flowing in from the storage tank main body to the toilet main body, the pump being provided downstream of the storage tank main body, a float switch including a sensing unit that moves up and down according to a water level in the storage tank main body, the float switch being provided at an upper part in the storage tank main body, and a controller configured to control the water supply part and a drive unit of the pump based on the water level detected by the float switch, and a collision part provided inside the storage tank main body, the flush water supplied from the small tank being colliding against the collision part, the collision part being configured to cause the flush water after collision to fall onto a water surface on a side of the float switch in the storage tank main body.

According to the flush toilet described above, the flush water that is supplied from the water supply part to the storage tank main body via the small tank collides against the collision part in the storage tank main body, and at least a part of the flush water may thus fall onto the water surface on the float switch side.

The water surface around the sensing unit of the float switch in the storage tank main body may thus be caused to ripple by such falling of the flush water, and water may be appropriately applied to the sensing unit of the float switch by such rippling of the water surface.

Accordingly, water scale and the like may be prevented from being deposited on the sensing unit of the float switch, and the sensing unit may be enabled to move smoothly up and down, and thus, reliable operation of the float switch may be secured, and reliability of the float switch may be increased.

Furthermore, because malfunctioning of the float switch at the time of water supply may be prevented, erroneous operation of the tank device or overflowing of the water level in the storage tank main body caused by malfunctioning of the float switch may be prevented.

In the present disclosure, preferably, the pump further includes a water passage pipe extending from the drive unit of the pump to an upstream side, the water passage pipe including an external water passage pipe connecting the drive unit of the pump and the storage tank main body and an internal water passage pipe connected to an upstream side of the external water passage pipe and provided inside the storage tank main body, and the collision part is provided on the internal water passage pipe, and the controller is configured to control to drive the drive unit of the pump during supply of water from the water supply part to the small tank.

According to the flush toilet described above, the drive unit of the pump is driven under control of the controller during supply of water from the water supply part to the small tank. Then, the flush water that is supplied from the water supply part to the storage tank main body via the small tank collides against the collision part on the internal water passage pipe in the storage tank main body.

At this time, because oscillation of the drive unit of the pump is transmitted to the collision part on the internal water passage pipe via the external water passage pipe, the collision part itself may be caused to subtly oscillate.

Accordingly, the flush water colliding against the oscillating collision part may fall onto the water surface over a wide range including the water surface on the float switch side in the storage tank main body, and cause the water surface in the storage tank main body to ripple over a wide range, and water may be appropriately applied to the sensing unit of the float switch.

Accordingly, deposits may be effectively prevented from being applied on the sensing unit of the float switch, and malfunctioning of the float switch may be effectively prevented.

Furthermore, the drive unit of the pump may be driven under control of the controller during supply of water from the water supply part to the small tank, and the flush water may thus be fed under pressure from the storage tank main body to the toilet main body, and supply of water to the storage tank main body and supply of flush water by the pump to the toilet main body may be simultaneously performed.

Accordingly, even if the tank capacity is limited because the storage tank main body and the small tank are disposed in a limited space behind the toilet main body, the risk of overflow due to a rapid rise in the water level in the storage tank main body during water supply may be reduced.

In the present disclosure, preferably, the collision part is formed as a curved surface on an upper surface of the internal water passage pipe.

According to the flush toilet described above, because the collision part is formed as a curved surface on the upper surface of the internal water passage pipe in the storage tank main body, when the flush water that is supplied from the water supply part to the storage tank main body via the small tank collides against the collision part, the flush water may flow down along the curved surface.

Accordingly, the flush water colliding against the collision part may be prevented from splashing upward, and also, the flush water colliding against the collision part may efficiently fall onto the water surface in the storage tank main body to effectively cause rippling, and water may thus be applied to the sensing unit of the float switch to such a degree that no deposits are applied on the sensing unit.

In the present disclosure, preferably, the collision part is provided on an upper surface of the internal water passage pipe and is located below a communicating hole between the storage tank main body and the small tank, the collision part being located at a position higher than a lower end of the sensing unit of the float switch.

According to the flush toilet described above, the flush water that is supplied from the water supply part to the small tank flows into the storage tank main body via the communicating hole at the storage tank main body, and at least a part of the flush water may collide against the collision part on the upper surface of the internal water passage pipe that is at a position below the communicating hole.

Then, the flush water colliding against the collision part flows down along the curved surface of the collision part on the upper surface of the internal water passage pipe and falls onto the water surface near the lower end of the sensing unit of the float switch in the storage tank main body, and rippling may be more effectively caused.

Accordingly, water may be applied to the sensing unit of the float switch to such a degree that no deposits are applied on the sensing unit.

In the present disclosure, preferably, the tank device further includes a suction pipe into which the flush water in the storage tank main body is suctioned by operation of the drive unit of the pump, the suction pipe being provided on an upstream side of the internal water passage pipe, the collision part is provided on an upper surface of the internal water passage pipe horizontally extending in a left-right direction from a downstream end of the suction pipe to the external water passage pipe, and the float switch is disposed on a side perpendicular to an axial direction of the internal water passage pipe.

According to the flush toilet described above, the float switch is disposed inside the storage tank main body, on the side perpendicular to the axial direction of the internal water passage pipe, and thus, the flush water colliding against the collision part may more efficiently fall onto the water surface in the storage tank main body, and the water surface may be more effectively caused to ripple.

Furthermore, by disposing the float switch on the side perpendicular to the axial direction of the internal water passage pipe and maintaining an appropriate distance between the sensing unit of the float switch and the collision part, a larger tank capacity may be secured for the storage tank main body.

In the present disclosure, preferably, the discharge trap extends, in a plan view, in a front-back direction from an inlet connected to the bowl to an outlet behind the bowl, and the storage tank main body is disposed in a manner surrounding an upper part of the discharge trap, the pump and the external water passage pipe from both left and right sides and from behind.

According to the flush toilet described above, the storage tank main body is disposed in a manner surrounding the upper part of the discharge trap, the pump and the external water passage pipe from both the left and right sides and from behind, and thus, the storage tank main body may be disposed by effectively using the limited space behind the toilet main body.

Accordingly, the size of the entire flush toilet may be reduced while securing a larger tank capacity.

In the present disclosure, preferably, the storage tank main body has a left-right asymmetrical shape including a large tank-main body section and a small tank-main body section, the large tank-main body section being a large-capacity side of the storage tank main body that is divided into two at a center in a left-right direction, the small tank-main body section being a small-capacity side of the storage tank main body that is divided into two at the center in the left-right direction, and the collision part, the suction pipe, and the sensing unit of the float switch are each provided inside the large tank-main body section.

According to the flush toilet described above, the storage tank main body has a left-right asymmetrical shape by including the large tank-main body section and the small tank-main body section, and also, the collision part, the suction pipe, and the sensing unit of the float switch are collectively provided in the large tank-main body section of the storage tank main body, and thus, a larger tank capacity may be secured by effectively using the limited space behind the toilet main body.

In the present disclosure, preferably, the large tank-main body section includes a rear large tank-main body section that is disposed behind the discharge trap, a front large tank-main body section that extends forward from the rear large tank-main body section and that is disposed on one of left and right sides of the discharge trap, and a lower large tank-main body section that extends downward from the rear large tank-main body section, the small tank-main body section includes a rear small tank-main body section that is disposed behind the discharge trap, and a front small tank-main body section that extends forward from the rear small tank-main body section and that is disposed on another one of the left and right sides of the discharge trap, a front end of the front large tank-main body section is disposed more forward than a front end of the front small tank-main body section, a bottom surface of the lower large tank-main body section is located at a position that is lower than a bottom surface of each of the rear small tank-main body section and the front small tank-main body section, and the float switch is a single float switch that is provided at an upper part in the rear large tank-main body section.

According to the flush toilet described above, the storage tank main body may have a left-right asymmetrical shape by including the rear large tank-main body section, the front large tank-main body section and the lower large tank-main body section of the large tank-main body section and the rear small tank-main body section and the front small tank-main body section of the small tank-main body section, and also, the float switch is a single float switch that is provided at an upper position in the rear large tank-main body section of the storage tank main body, and thus, a space that is occupied by the float switch may be reduced.

Accordingly, a larger tank capacity may be secured by effectively using the limited space behind the toilet main body, and also, the size of the entire flush toilet may be reduced.

According to the flush toilet of the present disclosure, malfunctioning of the float switch may be prevented and reliability of the float switch may be increased.

DETAILED DESCRIPTION

Hereinafter, a flush toilet according to an embodiment of the present disclosure will be described with reference to the appended drawings.

Figure 1:
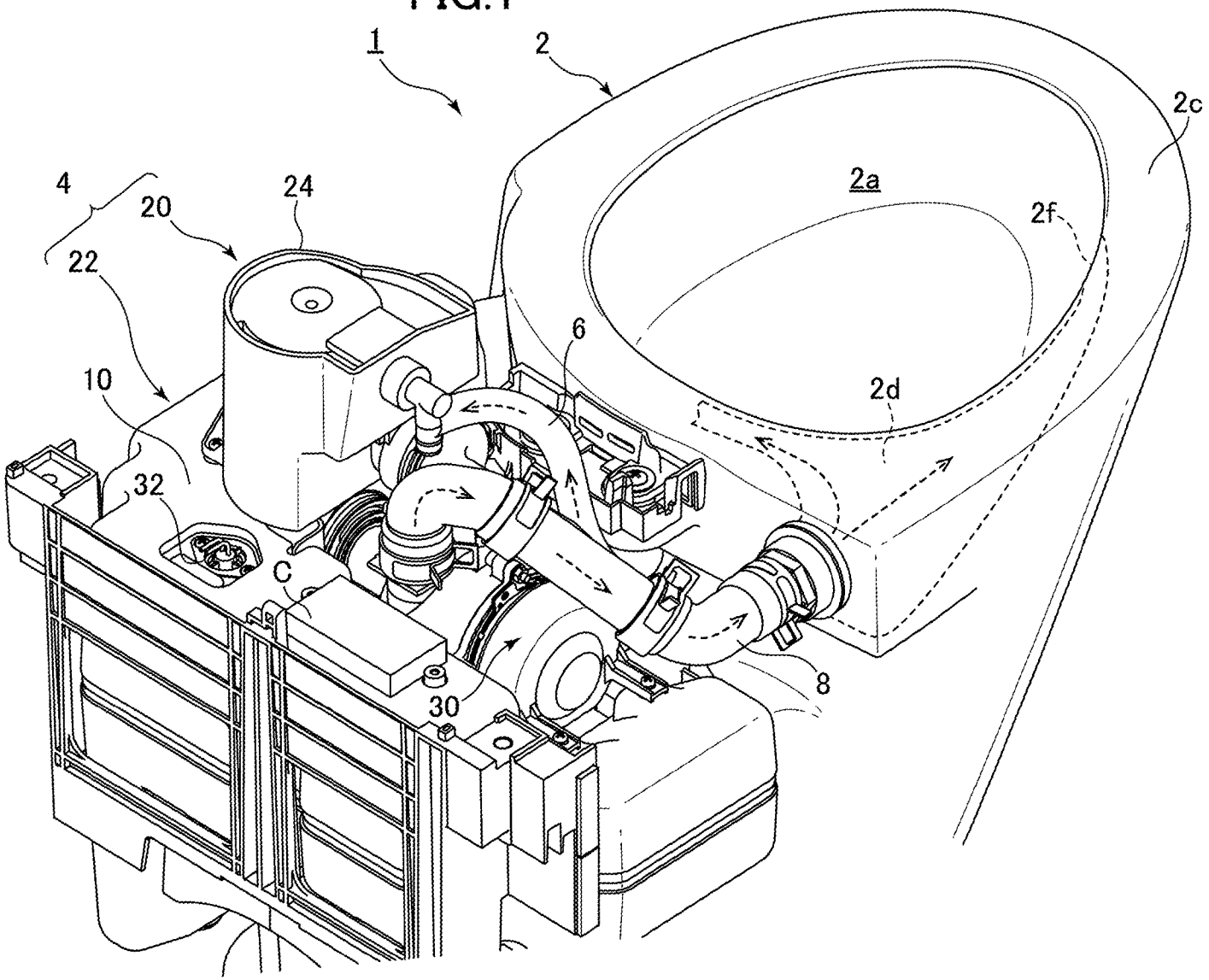
FIG. 1 is a schematic perspective view showing a flush toilet according to an embodiment of the present disclosure, where the flush toilet is seen obliquely from behind and above.

First, FIG. 1 is a schematic perspective view showing the flush toilet according to the embodiment of the present disclosure, where the flush toilet is seen obliquely from behind and above. Furthermore, FIG. 2 is an overall configuration diagram of the flush toilet according to the embodiment of the present disclosure.

Figure 2:
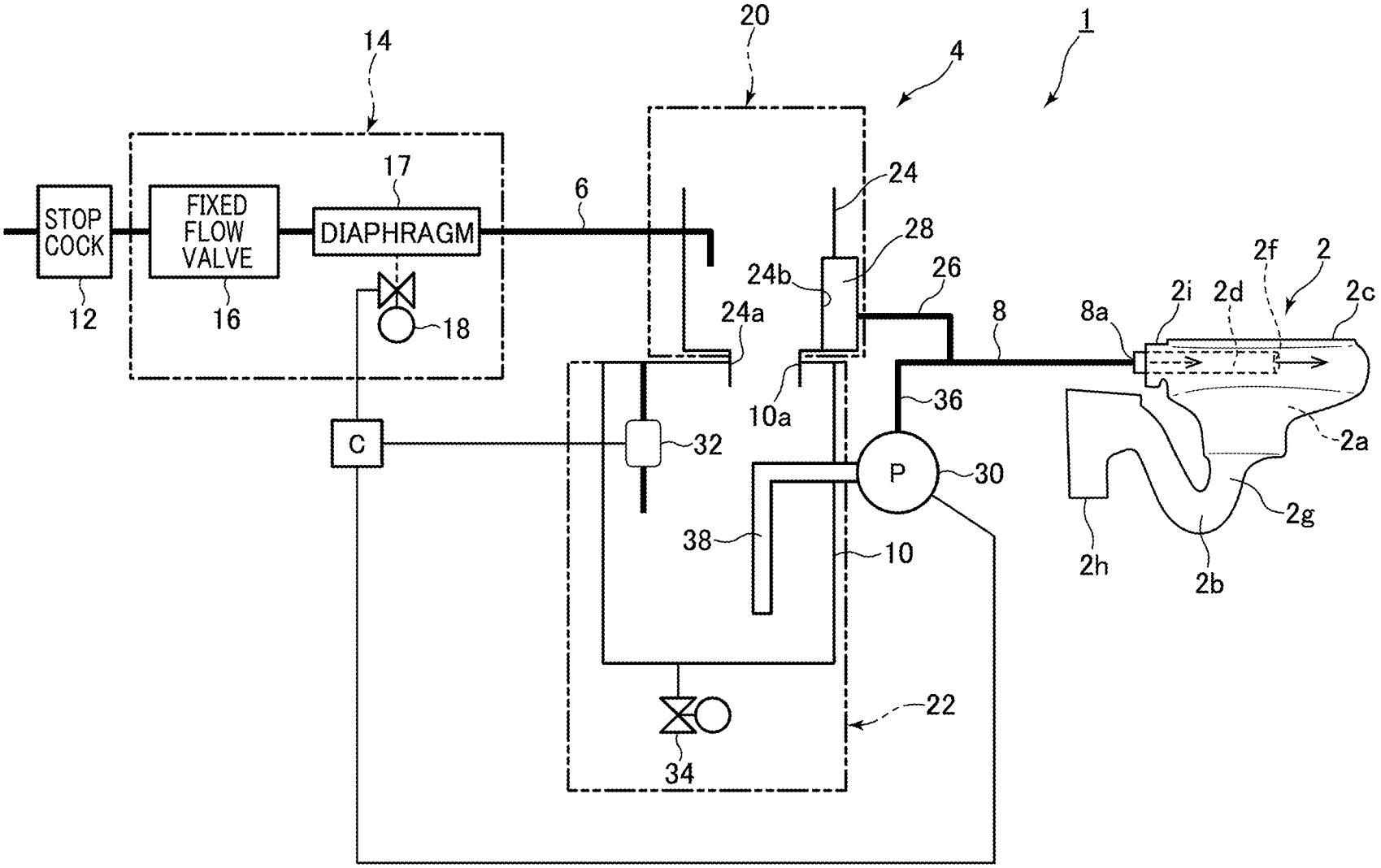
FIG. 2 is an overall configuration diagram of the flush toilet according to the embodiment of the present disclosure.

As shown in FIGS. 1 and 2, a flush toilet 1 according to the embodiment of the present disclosure includes a toilet main body 2 made of ceramics, and a tank device 4 that is provided behind the toilet main body 2.

Furthermore, the toilet main body 2 includes a bowl 2*a* for receiving waste, a discharge trap (a discharge trap pipe 2*b*) for discharging waste in the bowl 2*a*, the discharge trap extending from a bottom portion of the bowl 2*a*, and a rim portion 2*c* formed at a top edge of the bowl 2*a*.

Next, as shown in FIGS. 1 and 2, the tank device 4 includes a water supply pipe 6 (a water supply part) and a water discharge pipe 8 that are connected, respectively, on an upstream side and a downstream side of the tank device 4.

An upstream side of the water supply pipe 6 is connected to an external water supply source (not shown) such as a water system. A downstream side of the water supply pipe 6 is connected to a storage tank 10 (of which more later) of the tank device 4. Flush water is thus supplied from the water supply pipe 6 to the storage tank 10.

Furthermore, a stop cock 12 and a valve unit 14 are provided on the water supply pipe 6, from the upstream side to the downstream side.

Moreover, the valve unit 14 includes a fixed flow valve 16 provided on the water supply pipe 6, and an electromagnetic valve 18 for opening/closing an on-off valve (a diaphragm valve 17) provided downstream of the fixed flow valve 16.

Next, as shown in FIGS. 1 and 2, the tank device 4 further includes a connecting unit 20 that is connected downstream of the valve unit 14 of the water supply pipe 6, and a tank unit 22 connected on a downstream side of the connecting unit 20 and including the storage tank 10.

At the valve unit 14, a flow rate of flush water in the water supply pipe 6 is adjusted to be constant by the fixed flow valve 16.

Then, when the electromagnetic valve 18 is electromagnetically opened, and a flow path in the water supply pipe 6 is released by the on-off valve (the diaphragm valve 17), the flush water in the water supply pipe 6 is supplied to the tank unit 22 through the connecting unit 20.

That is, the valve unit 14 as a whole functions, together with the water supply pipe 6, as a water supply part that supplies flush water that is supplied from a water supply source such as a water system to the storage tank 10.

As shown in FIG. 2, the connecting unit 20 includes a water receiving housing 24 (a small tank), an overflow pipe 26, and a check valve 28.

Moreover, a lower opening 24*a* of the water receiving housing 24 is detachably connected to an upper opening 10*a* of the storage tank 10 of the tank unit 22. Additionally, details of the water receiving housing 24 and a periphery of the water receiving housing 24 will be given later.

The overflow pipe 26 connects an overflow port 24*b* provided in a part of a side wall of the water receiving housing 24 and the water discharge pipe 8. The water discharge pipe 8 is a connecting pipe (a flush water supply pipe), an upstream side of the water discharge pipe 8 is connected to a pump 30 of the tank device 4, and a downstream side of the water discharge pipe 8 is connected to a rim conduit 2*d* inside the rim portion 2*c* of the toilet main body 2.

Moreover, the check valve 28 is provided at the overflow port 24*b*, and is capable of allowing flush water in the water receiving housing 24 to flow into the overflow pipe 26 from the overflow port 24*b* while preventing flush water in the overflow pipe 26 from flowing backward into the water receiving housing 24.

Next, as shown in FIG. 2, the tank unit 22 includes the storage tank 10, the pump 30, a float switch 32, a drain plug 34, a controller C and the like.

The pump 30 is provided on a part (midstream) of a water passage pipe 36 connected on an upstream side of the water discharge pipe 8. An upstream end 36*a* of the water passage pipe 36 is connected to a downstream end 38*a* of a suction pipe 38 provided in the storage tank 10.

Additionally, details of the water passage pipe 36 and the suction pipe 38 will be given later.

Flush water stored in the storage tank 10 is suctioned from the suction pipe 38 into the water passage pipe 36 by operation of the pump 30, and is then fed under pressure to the water discharge pipe 8 via the pump 30.

All the flush water that is supplied from the storage tank 10 to the water discharge pipe 8 by the pump 30 is thus supplied into the rim conduit 2*d* from an inlet 2*e* of the rim conduit 2*d*.

Then, the flush water in the rim conduit 2*d* is discharged into the bowl 2*a* from a rim spouting port 2*f* on a downstream end of the rim conduit 2*d*, and toilet flushing (toilet flushing by so-called 100% rim spouting) is thus performed.

That is, the water passage pipe 36 and the water discharge pipe 8 each function as a flush water supply pipe for supplying flush water that is fed under pressure from the storage tank 10 by the pump 30 to the toilet main body 2.

The float switch 32 detects a water level inside the storage tank 10. An opening/closing operation of the electromagnetic valve 18 of the valve unit 14 is controlled by the controller C based on the water level inside the storage tank 10 that is detected by the float switch 32.

Furthermore, the operation of the pump 30 is also controlled by the controller C based on the water level inside the storage tank 10 that is detected by the float switch 32.

For example, in the case where the water level inside the storage tank 10 that is detected by the float switch 32 is at or below a predetermined water level, the electromagnetic valve 18 is opened, the water supply pipe 6 is released, and the pump 30 is caused to operate.

Then, when the water level inside the storage tank 10 reaches the predetermined water level, the electromagnetic valve 18 is closed, the water supply pipe 6 is closed, and the pump 30 is stopped.

Furthermore, the pump 30 may be controlled and driven by the controller C while water is being supplied from the water supply pipe 6 to the storage tank 10, and flush water may thus be fed under pressure from the storage tank 10 to the toilet main body 2, and supply of water from the water supply pipe 6 to the storage tank 10 and supply of flush water by the pump 30 to the toilet main body 2 may be simultaneously performed.

The drain plug 34 is provided in a bottom surface of the storage tank 10. In normal use, the drain plug 34 is closed at all times, and the drain plug 34 can be removed as necessary to discharge the flush water in the storage tank 10 to outside.

Next, details of the storage tank 10 of the tank unit 22 will be given with reference to FIGS. 3 to 6.

Figure 3:
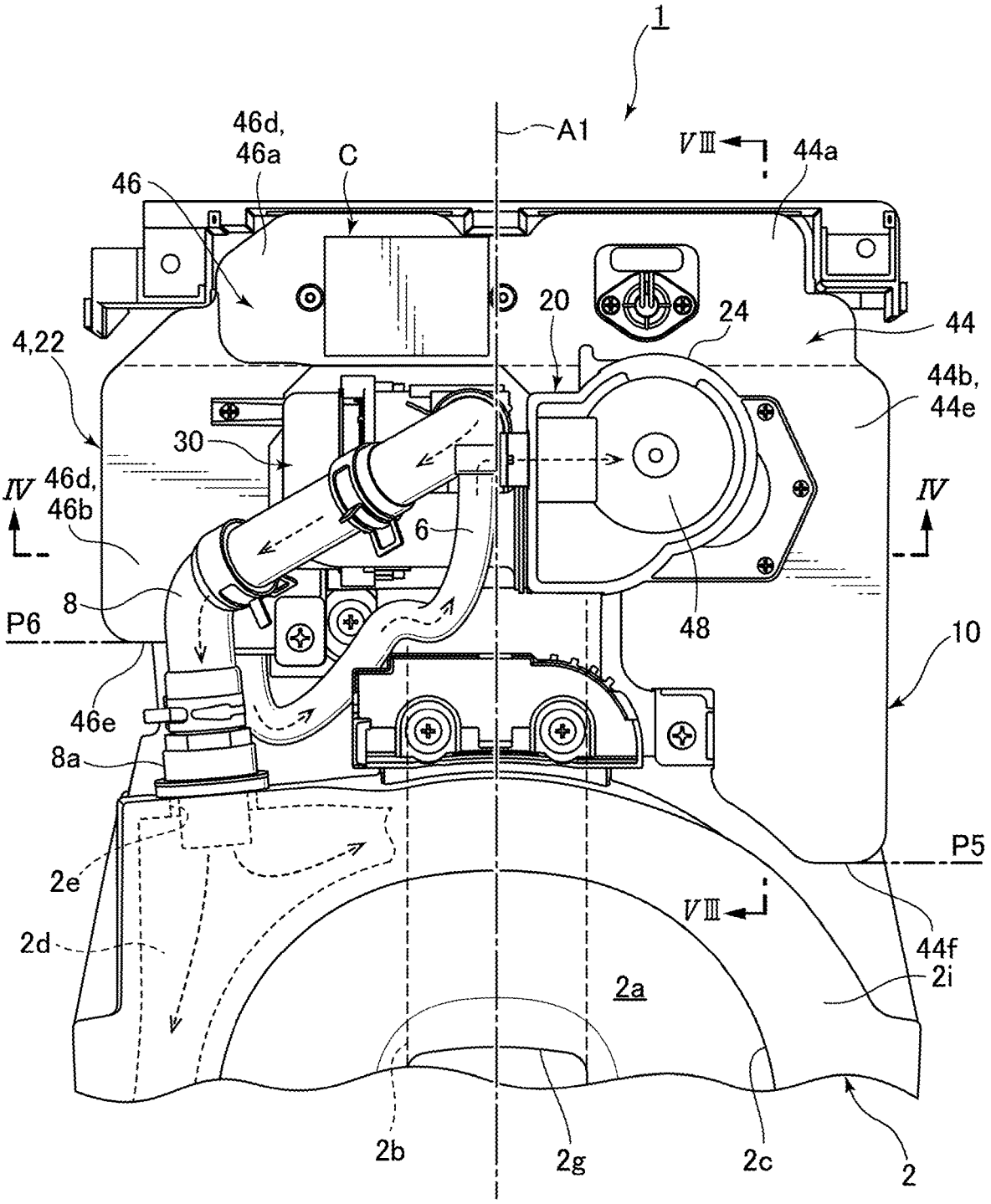
FIG. 3 is an enlarged partial plan view showing a part of the flush toilet according to the embodiment of the present disclosure in an enlarged manner, the part corresponding to a tank unit.

FIG. 3 is an enlarged partial plan view showing a part of the flush toilet according to the embodiment of the present disclosure in an enlarged manner, the part corresponding to the tank unit. Furthermore, FIG. 4 is a cross-sectional view taken along a line IV-IV in FIG. 3.

Figure 4:
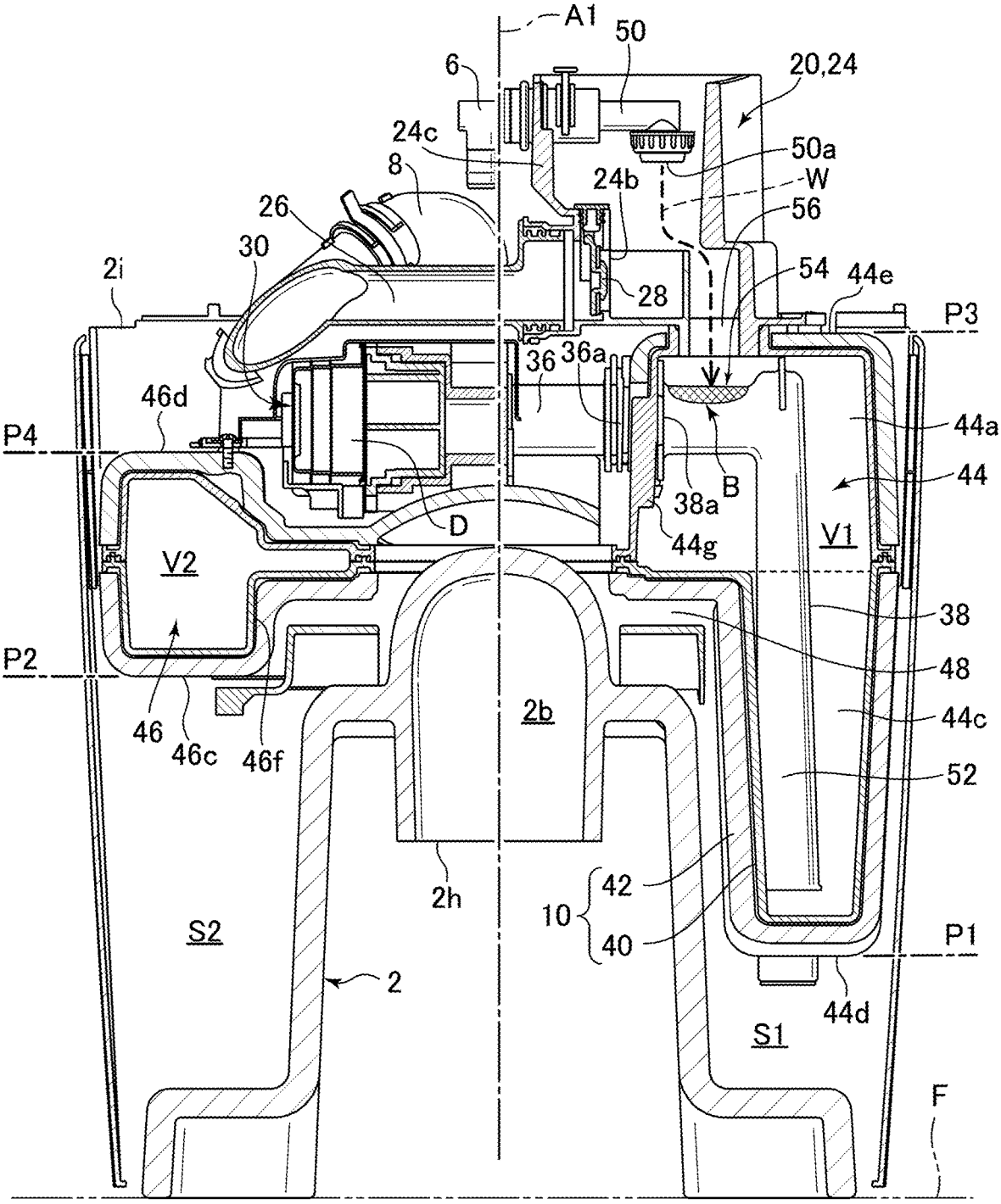
FIG. 4 is a cross-sectional view taken along a line IV-IV in FIG. 3.

First, as shown in FIGS. 3 and 4, the storage tank 10 of the tank unit 22 includes a single tank main body 40, and an antisweat material 42 covering an outside of the tank main body 40.

Figure 5:
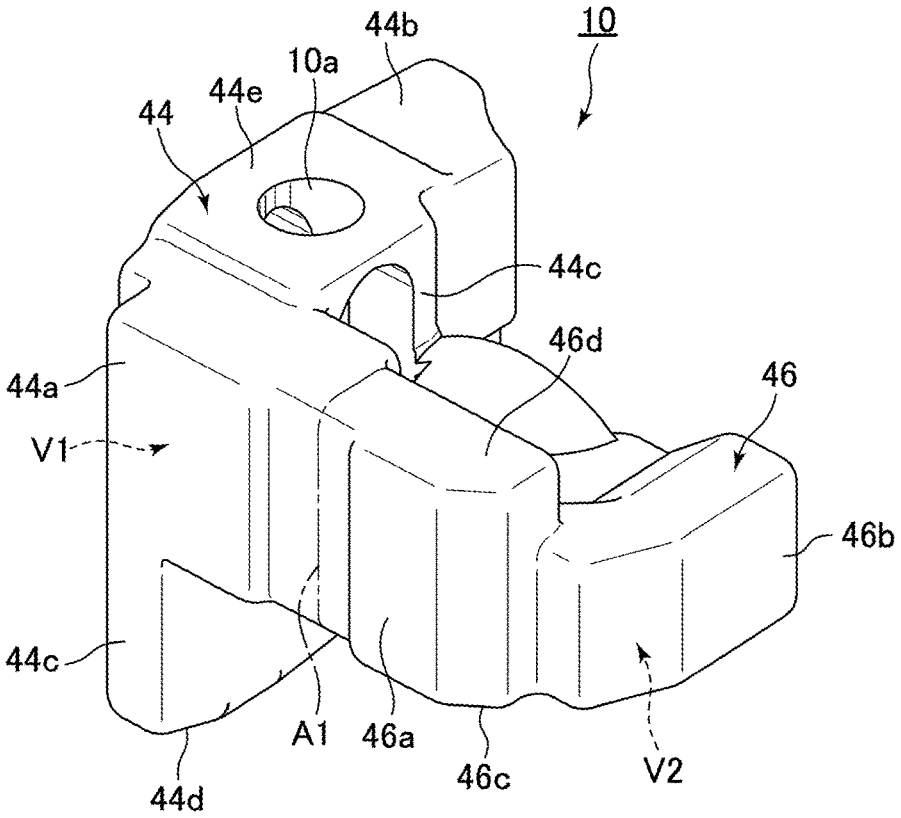
FIG. 5 is a perspective view showing a storage tank of the flush toilet according to the embodiment of the present disclosure, where the storage tank is seen obliquely from behind and above.

Next, FIG. 5 is a perspective view showing the storage tank of the flush toilet according to the embodiment of the present disclosure, where the storage tank is seen obliquely from behind and above. Furthermore, FIG. 6 is a rear view of the storage tank of the flush toilet according to the embodiment of the present disclosure.

As shown in FIGS. 3 to 6, when a virtual vertical plane that divides the storage tank 10 of the tank unit 22 into two at a center in a left-right direction is taken as "vertical plane A1", the single tank main body 40 of the storage tank 10 and the antisweat material 42 on the outside include a large tank section 44 and a small tank section 46 on left and right of the vertical plane A1, and are divided into two in the left-right direction by the vertical plane A1, into the large tank section 44 and the small tank section 46.

Figure 6:
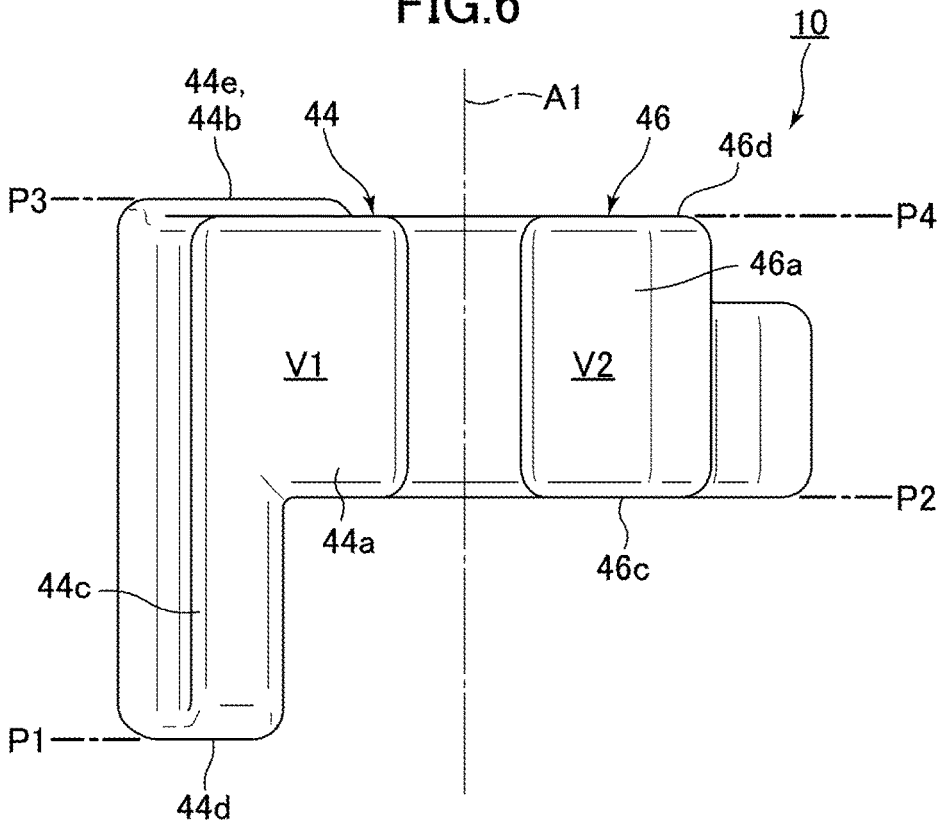
FIG. 6 is a rear view of the storage tank of the flush toilet according to the embodiment of the present disclosure.

That is, as shown in FIG. 6, when the tank main body 40 and the antisweat material 42 are seen from a rear surface side, the large tank section 44 is disposed on a left side of the vertical plane A1, and when the tank main body 40 and the antisweat material 42 are seen from the rear surface side, the small tank section 46 is disposed on a right side of the vertical plane A1, and a capacity V1 of the large tank section 44 is set greater than a capacity V2 of the small tank section 46 (V1>V2).

Accordingly, because of the large tank section 44 and the small tank section 46, the storage tank 10 has a left-right asymmetrical shape (a deformed shape of an approximately C-shape or U-shape in a plan view).

Furthermore, as shown in FIGS. 1, 3, and 4, the discharge trap pipe 2*b* of the toilet main body 2 extends in a front-back direction from an inlet 2*g* connected to a lower part of the bowl 2*a* to an outlet 2*h* behind the bowl 2*a*.

Furthermore, as shown in FIGS. 3 to 6, the large tank section 44 of the storage tank 10 includes a rear large tank section 44*a* disposed behind the discharge trap pipe 2*b*, a front large tank section 44*b* extending forward from the rear large tank section 44*a* while being disposed on one of left and right sides of the discharge trap pipe 2*b* (the right side when the toilet main body 2 is seen from the front), and a lower large tank section 44*c* extending downward from the rear large tank section 44*a*.

Next, as shown in FIGS. 3 to 6, the small tank section 46 of the storage tank 10 includes a rear small tank section 46*a* disposed behind the discharge trap pipe 2*b*, and a front small tank section 46*b* extending forward from the rear small tank section 46*a* while being disposed on the other of the left and right sides of the discharge trap pipe 2*b* (the left side when the toilet main body 2 is seen from the front).

That is, as shown in FIGS. 1, 3, and 4, the storage tank 10 is disposed in a manner surrounding an upper part of the discharge trap pipe 2*b* from both the left and right sides and from behind.

Next, as shown in FIG. 4, the toilet main body 2 includes, in a region behind the bowl 2*a*, a large-tank housing section S1 and a small-tank housing section S2 for housing the large tank section 44 and the small tank section 46, respectively, at a position higher than a floor surface.

That is, in the region behind the bowl 2*a* of the toilet main body 2, the large-tank housing section 51 is formed on one of left and right sides of the vertical plane A1 that divides the region into two at the center in the left-right direction (on the right side of the vertical plane A1 when the toilet main body 2 is seen from front).

In the region behind the bowl 2*a* of the toilet main body 2, the small-tank housing section S2 is formed on the other one of the left and right sides of the vertical plane A1 (on the left side of the vertical plane A1 when the toilet main body 2 is seen from the front).

Furthermore, as shown in FIGS. 4 to 6, in a state where the large tank section 44 and the small tank section 46 are disposed in the large-tank housing section S1 and the small-tank housing section S2, respectively, a lowest position of a bottom surface of the large tank section 44 (a lowest position P1 of a bottom surface 44*d* of the lower large tank section 44*c*) is at a position lower than a lowest position of a bottom surface of the small tank section 46 (a lowest position P2 of a bottom surface 46*c* of the rear small tank section 46*a* and the front small tank section 46*b*).

Furthermore, as shown in FIGS. 4 to 6, in the state where the large tank section 44 and the small tank section 46 are disposed in the large-tank housing section S1 and the small-tank housing section S2, respectively, a highest position of an upper surface of the large tank section 44 (a highest position P3 of an upper surface 44*e* of the front large tank section 44*b*) is at a position higher than a highest position P4 of an upper surface 46*d* of the rear small tank section 46*a* and the front small tank section 46*b* of the small tank section 46 and lower than an upper surface 2*i* of the rim portion 2*c* of the toilet main body 2.

Furthermore, as shown in FIGS. 3 to 6, a position P5 of a front end 44*f* of the front large tank section 44*b* is positioned more forward than a position P6 of a front end 46*e* of the front small tank section 46*b*.

As shown in FIGS. 2 and 4, the suction pipe 38 is provided extending inside both the rear large tank section 44*a* and the lower large tank section 44*c* of the large tank section 44 of the tank main body 40. Furthermore, the upstream end 36*a* of the water passage pipe 36 extending on an upstream side (sideways) from the pump 30 is connected to the downstream end 38*a* of the suction pipe 38, that is a part of the large tank section 44, in a watertight manner.

Furthermore, as shown in FIG. 3, an upstream end of the water discharge pipe 8 is connected to a downstream end of the water passage pipe 36 extending on a downstream side (upward) from the pump 30, and a downstream end (an outlet 8*a*) of the water discharge pipe 8 is connected to the inlet 2*e* of the rim conduit 2*d* on the other one of the left and right sides of the vertical plane A1 of the toilet main body 2 (on the left side of the vertical plane A1 when the toilet main body 2 is seen from the front).

Next, as shown in FIG. 4, a side wall surface 44*g* of the large tank section 44, on the side of the vertical plane A1 (at the center in the left-right direction), is positioned inside the large-tank housing section S1 and outward of the discharge trap pipe 2*b* (on the right side when the discharge trap pipe 2*b* is seen from the front).

Likewise, a side wall surface 46*f* of the small tank section 46, on the side of the vertical plane A1 (at the center in the left-right direction), is positioned inside the small-tank housing section S2 and outward of the discharge trap pipe 2*b* (on the left side when the discharge trap pipe 2*b* is seen from the front).

Furthermore, as shown in FIGS. 4 and 5, the discharge trap pipe 2*b* is provided at the center of the toilet main body 2 in the left-right direction, and the upstream end 36*a* of the water passage pipe 36 is connected to the side wall surface 44*g* that is the side surface, of the large tank section 44, on the discharge trap pipe 2*b* side, of left and right side surfaces of the large tank section 44.

Furthermore, as shown in FIGS. 3 and 4, the pump 30 is disposed behind the bowl 2*a* of the toilet main body 2, at a position higher than the discharge trap pipe 2*b*. Moreover, the pump 30 is disposed more forward than the rear large tank section 44*a* and the rear small tank section 46*a*, and in a space between the front large tank section 44*b* and the front small tank section 46*b* in the left-right direction.

Accordingly, the pump 30 is provided more to the center of the toilet main body 2 in the left-right direction than the upstream end 36*a* of the water passage pipe 36 and the downstream end (the outlet 8*a*) of the water discharge pipe 8.

Next, details will be given with reference to FIGS. 1 to 8, of the water receiving housing 24 (a small tank) of the connecting unit 20 of the flush toilet 1 according to the embodiment of the present disclosure, and the water passage pipe 36 and the suction pipe 38 outside and inside the storage tank 10.

Figure 7:
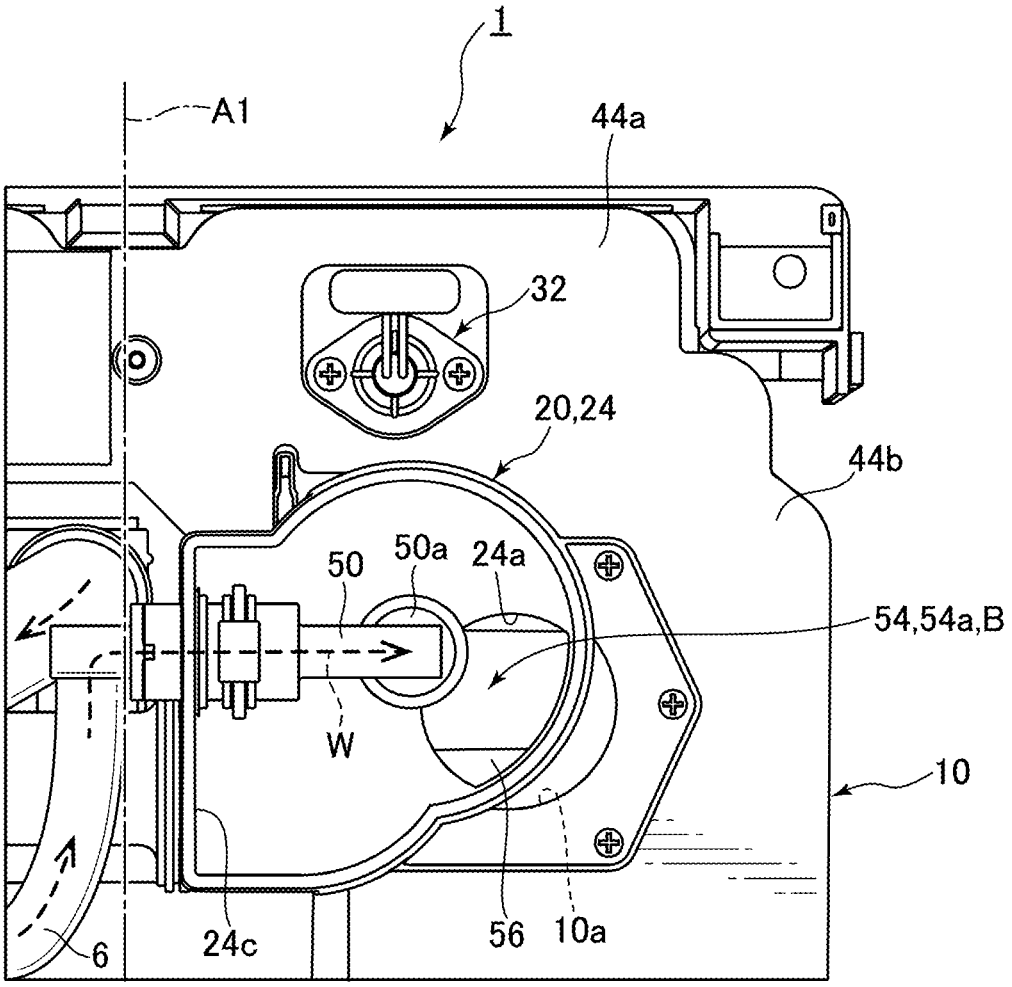
FIG. 7 is an enlarged partial plan view showing, in an enlarged manner, a water receiving housing part of the flush toilet according to the embodiment of the present disclosure shown in FIG. 3.
Figure 8:
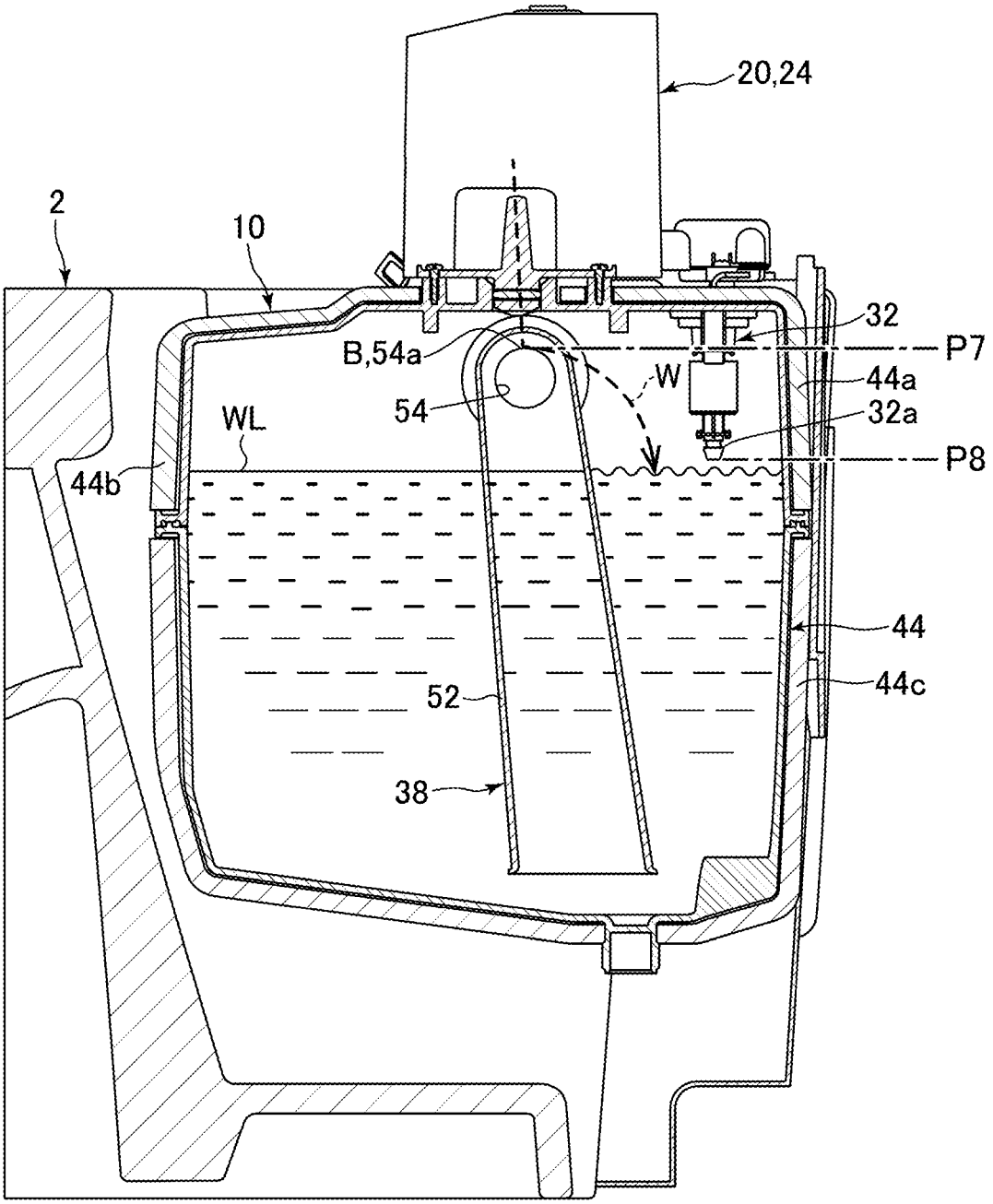
FIG. 8 is a cross-sectional view taken along a line VIII-VIII in FIG. 3.

FIG. 7 is an enlarged partial plan view showing, in an enlarged manner, a water receiving housing part of the flush toilet according to the embodiment of the present disclosure shown in FIG. 3. Furthermore, FIG. 8 is a cross-sectional view taken along a line VIII-VIII in FIG. 3.

Additionally, regarding the water receiving housing 24 of the connecting unit 20 shown in FIGS. 4 and 7, a state where an upper lid 48 of the water receiving housing 24 shown in FIG. 3 is removed is shown.

First, as shown in FIGS. 4 and 7, the water supply pipe 6 is connected to an upper part of a side wall 24*c* of the water receiving housing 24 of the connecting unit 20, the side wall 24*c* being on the left side when the toilet main body 2 is seen from the front. A water supply nozzle 50 (a water supply part) that extends into the water receiving housing 24 is provided on a downstream side of the water supply pipe 6.

Furthermore, a water supply port 50*a* (the water supply part) that faces downward is provided at a distal end portion of the water supply nozzle 50.

Moreover, the overflow pipe 26 is connected, via the check valve 28, to the overflow port 24*b* at a lower part of the side wall 24*c* of the water receiving housing 24.

Next, as shown in FIGS. 4, 7, and 8, the suction pipe 38 inside the storage tank 10 includes a vertical water passage pipe 52 that extends in a top-bottom direction, and a transverse water passage pipe 54 that horizontally extends in the left-right direction from a top end portion of the vertical water passage pipe 52.

Furthermore, the water passage pipe 36 horizontally extends from a drive unit D of the pump 30 in the left-right direction (on an upstream side), and the upstream end 36*a* is an external water passage pipe that is connected to the side wall surface 44*g* of the large tank section 44 of the storage tank 10 from outside.

Furthermore, the transverse water passage pipe 54 of the suction pipe 38 is an internal water passage pipe, the downstream end 38*a* of which is connected to the upstream end 36*a* of the water passage pipe 36 (the external water passage pipe) and disposed inside the large tank section 44 of the storage tank 10.

Moreover, the downstream end 38*a* of the transverse water passage pipe 54 (the internal water passage pipe) is connected at the side wall surface 44*g* of the large tank section 44 of the storage tank 10 to the upstream end 36*a* of the water passage pipe 36 (the external water passage pipe) on the outside in a watertight manner.

The transverse water passage pipe 54 is formed into a cylindrical shape, and thus, a collision part (a collision region surface B) formed on an upper surface 54*a* of the transverse water passage pipe 54 is formed as a curved surface.

Next, as shown in FIGS. 4, 7, and 8, the collision region surface B (the collision part) provided on the upper surface 54*a* of the transverse water passage pipe 54 (the internal water passage pipe) is located below a communicating hole 56 between the storage tank 10 (a storage tank main body) and the water receiving housing 24 (the small tank).

Furthermore, a height position P7 of the collision region surface B is located at a position higher than a lower end (a position P8) of a sensing unit 32*a* of the float switch 32.

Moreover, as shown in FIGS. 7 and 8, the float switch 32 is a single float switch 32 that is disposed inside the storage tank 10, on a side (rear side) perpendicular to an axial direction of the transverse water passage pipe 54.

Accordingly, as shown in FIGS. 4, 7, and 8, flush water W that is discharged from the water supply port 50*a* flows through the communicating hole 56 between the lower opening 24*a* of the water receiving housing 24 (the small tank) and the upper opening 10*a* of the storage tank 10 (the storage tank main body).

Then, as shown in FIGS. 4, 7, and 8, supply water (the flush water W) passing through communicating hole 56 and flowing into the storage tank 10 falls onto the collision part (the collision region surface B) on the upper surface 54*a* of the transverse water passage pipe 54, and then, at least a part of the flush water W falls onto a water surface WL on the float switch 32 side in the storage tank 10.

The water surface WL near a lower end of the sensing unit 32*a* of the float switch 32 inside the rear large tank section 44*a* of the storage tank 10 is thus caused to ripple.

Then, water drops or mist-like water drops are finely dispersed and are caused to be attached to the sensing unit 32*a* of the float switch 32, and the sensing unit 32*a* of the float switch 32 is kept in a moistened state and is enabled to operate at all times without deposits being applied thereon.

The sensing unit 32*a* of the float switch 32 is placed in an on state when the water surface WL in the storage tank 10 rises and contacts the lower end of the sensing unit 32*a*.

On the other hand, in the case where the water surface WL in the storage tank 10 is lower than the lower end position of the sensing unit 32*a* of the float switch 32, the sensing unit 32*a* of the float switch 32 is placed in an off state.

Next, effects of the flush toilet 1 according to the embodiment of the present disclosure described above will be described with reference to FIGS. 1 to 8.

As shown in FIGS. 4, 7, and 8, with the flush toilet 1 according to the present embodiment, the flush water W that is supplied from the water supply port 50*a* of the water supply nozzle 50 to the storage tank 10 (the storage tank main body) via the water receiving housing 24 (the small tank) falls and collides from above against the collision region surface B on the upper surface 54*a* of the transverse water passage pipe 54 in the front large tank section 44*b* of the storage tank 10.

At least a part of the flush water W may thus fall onto the water surface WL on the float switch 32 side.

The water surface around the sensing unit 32*a* of the float switch 32 in the rear large tank section 44*a* of the storage tank 10 may thus be caused to ripple by such falling of the flush water W. Accordingly, water may be appropriately applied to the sensing unit 32*a* of the float switch 32 by such rippling of the water surface WL.

Accordingly, water scale and the like may be prevented from being deposited on the sensing unit 32*a* of the float switch 32, and the sensing unit 32*a* may be enabled to move smoothly up and down.

Therefore, reliable operation of the float switch may be secured, and reliability of the float switch may be increased.

Furthermore, because malfunctioning of the float switch 32 at the time of water supply may be prevented, erroneous operation of the tank device 4 or overflowing of the water level WL in the storage tank 10 caused by malfunctioning of the float switch 32 may be prevented.

Next, with the flush toilet 1 according to the present embodiment, the drive unit D of the pump 30 is driven under control of the controller C during supply of water from the water supply port 50*a* of the water supply nozzle 50 (the water supply part) to the water receiving housing 24 (the small tank).

Then, the flush water W that is supplied from the water supply port 50*a* of the water supply nozzle 50 to the storage tank 10 via the water receiving housing 24 collides against the collision region surface B on the upper surface 54*a* of the transverse water passage pipe 54 (the internal water passage pipe) in the front large tank section 44*b* of the storage tank 10.

At this time, because oscillation of the drive unit D of the pump 30 is transmitted to the collision region surface B of the transverse water passage pipe 54 (the internal water passage pipe) via the water passage pipe 36 (the external water passage pipe), the collision region surface B itself may be caused to subtly oscillate.

Accordingly, the flush water W colliding against the oscillating collision region surface B may fall onto the water surface WL over a wide range including the water surface on the float switch 32 side in the rear large tank section 44*a* of the storage tank 10. The water surface WL in the storage tank 10 may thus be caused to ripple over a wide range, and water may be appropriately applied to the sensing unit 32*a* of the float switch 32.

Accordingly, deposits may be effectively prevented from being applied on the sensing unit 32*a* of the float switch 32, and malfunctioning of the float switch 32 may be effectively prevented.

Furthermore, the drive unit D of the pump 30 may be driven under control of the controller C during supply of water from the water supply port 50*a* of the water supply nozzle 50 to the water receiving housing 24, and the flush water may thus be fed under pressure from the storage tank 10 to the toilet main body 2, and supply of water to the storage tank 10 and supply of flush water by the pump 30 to the toilet main body 2 may be simultaneously performed.

Accordingly, even if the tank capacity is limited because the storage tank 10 and the water receiving housing 24 are disposed in the limited space behind the toilet main body 2, the risk of overflow due to a rapid rise in the water level WL in the storage tank 10 during water supply may be reduced.

Next, with the flush toilet 1 according to the present embodiment, the collision region surface B is formed as a curved surface on the upper surface 54*a* of the transverse water passage pipe 54 (the internal water passage pipe) in the front large tank section 44*b* of the storage tank 10.

Accordingly, when the flush water W that is supplied from the water supply port 50*a* of the water supply nozzle 50 to the storage tank 10 via the water receiving housing 24 collides against the collision region surface B, the flush water W may flow down along the curved surface.

Accordingly, the flush water W colliding against the collision region surface B may be prevented from splashing upward, and also, the flush water W colliding against the collision region surface B may efficiently fall onto the water surface in the storage tank 10 to effectively cause rippling.

Water may thus be applied to the sensing unit 32*a* of the float switch 32 to such a degree that no deposits are applied on the sensing unit 32*a*.

Next, with the flush toilet 1 according to the present embodiment, the collision region surface B is located below the communicating hole 56 between the water receiving housing 24 and the storage tank 10 and higher than the lower end of the sensing unit 32*a* of the float switch 32.

Accordingly, the flush water W that is supplied from the water supply port 50*a* of the water supply nozzle 50 to the water receiving housing 24 flows into the storage tank 10 via the communicating hole 56 between the water receiving housing 24 and the storage tank 10, and at least a part of the flush water W may collide against the collision region surface B on the upper surface 54*a* of the transverse water passage pipe 54 (the internal water passage pipe) that is located below the communicating hole 56.

Then, the flush water W colliding against the collision region surface B flows down along the curved surface of the collision region surface B on the upper surface 54*a* of the transverse water passage pipe 54 and falls onto the water surface near the lower end of the sensing unit 32*a* of the float switch 32 in the storage tank 10, and rippling may be more effectively caused.

Accordingly, water may be applied to the sensing unit 32*a* of the float switch 32 to such a degree that no deposits are applied on the sensing unit 32*a*.

Next, with the flush toilet 1 according to the present embodiment, the float switch 32 is disposed inside the storage tank 10, on the side (rear side) perpendicular to the axial direction of the transverse water passage pipe 54.

Accordingly, the flush water W colliding against the collision region surface B may more efficiently fall onto the water surface WL in the storage tank 10, and the water surface WL may be more effectively caused to ripple.

Furthermore, by disposing the float switch 32 inside the storage tank 10, on the side perpendicular to the axial direction of the transverse water passage pipe 54 and maintaining an appropriate distance between the sensing unit 32*a* of the float switch 32 and the collision region surface B, a larger tank capacity may be secured for the storage tank 10.

Next, with the flush toilet 1 according to the present embodiment, the storage tank 10 is disposed in a manner surrounding the upper part of the discharge trap pipe 2*b*, the pump 30, and the water passage pipe 36 (the external water passage pipe) from both the left and right sides and from behind.

Accordingly, the storage tank 10 may be disposed by effectively using the limited space behind the toilet main body 2.

Accordingly, the size of the entire flush toilet 1 may be reduced while securing a larger tank capacity for the storage tank 10.

Next, with the flush toilet 1 according to the present embodiment, the storage tank 10 has a left-right asymmetrical shape by including the large tank section 44 and the small tank section 46, and also, the collision region surface B, the suction pipe 38, and the sensing unit 32*a* of the float switch 32 are collectively provided in the large tank section 44 of the storage tank 10, and thus, a larger tank capacity may be secured for the storage tank 10 by effectively using the limited space behind the toilet main body 2.

Next, with the flush toilet 1 according to the present embodiment, the storage tank 10 may have a left-right asymmetrical shape by including the rear large tank section 44*a*, the front large tank section 44*b* and the lower large tank section 44*c* of the large tank section 44 and the rear small tank section 46*a* and the front small tank section 46*b* of the small tank section 46.

Furthermore, the float switch 32 is a single float switch 32 that is provided at an upper position in the rear large tank section 44*a* of the storage tank 10, and thus, a space that is occupied by the float switch 32 may be reduced.

Accordingly, a larger tank capacity may be secured for the storage tank 10 by effectively using the limited space behind the toilet main body 2, and also, the size of the entire flush toilet 1 may be reduced.

Although the present disclosure has been explained with reference to specific, preferred embodiments, one of ordinary skill in the art will recognize that modifications and improvements can be made while remaining within the scope and spirit of the present disclosure. The scope of the present disclosure is determined solely by appended claims.

What is claimed is:

1. A flush toilet for flushing and discharging waste with flush water, the flush toilet comprising:

a toilet main body including a bowl configured to receive waste, a rim portion formed on a top edge of the bowl, and a discharge trap configured to discharge the waste in the bowl; and a tank device configured to supply flush water to the toilet main body, the tank device being provided behind the toilet main body, wherein the tank device includes a water supply part configured to supply the flush water that is supplied from a water supply source, a storage tank main body provided behind the toilet main body, above a floor surface, a small tank that is communicably connected to an upper part of the storage tank main body and to which a water supply pipe of the water supply part is connected, a pump configured to feed the flush water flowing in from the storage tank main body to the toilet main body, the pump being provided downstream of the storage tank main body, a float switch including a sensing unit that moves up and down according to a water level in the storage tank main body, the float switch being provided at an upper part in the storage tank main body, and a controller configured to control the water supply part and a drive unit of the pump based on the water level detected by the float switch, and a collision part provided inside the storage tank main body, the flush water supplied from the small tank being colliding against the collision part, the collision part being configured to cause the flush water after collision to fall onto a water surface on a side of the float switch in the storage tank main body from a collision positioned higher than the sensing unit of the float switch.

2. The flush toilet according to claim 1, wherein the pump further includes a water passage pipe extending from the drive unit of the pump to an upstream side, the water passage pipe including an external water passage pipe connecting the drive unit of the pump and the storage tank main body and an internal water passage pipe connected to an upstream side of the external water passage pipe and provided inside the storage tank main body, and the collision part is provided on the internal water passage pipe, and the controller is configured to control to drive the drive unit of the pump during supply of water from the water supply part to the small tank.

3. The flush toilet according to claim 2, wherein the collision part is formed as a curved surface on an upper surface of the internal water passage pipe.

4. The flush toilet according to claim 2, wherein the collision part is provided on an upper surface of the internal water passage pipe and is located below a communicating hole between the storage tank main body and the small tank, the collision part being located at a position higher than a lower end of the sensing unit of the float switch.

5. The flush toilet according to claim 2, wherein the tank device further includes a suction pipe into which the flush water in the storage tank main body is suctioned by operation of the drive unit of the pump, the suction pipe being provided on an upstream side of the internal water passage pipe, the collision part is provided on an upper surface of the internal water passage pipe horizontally extending in a left-right direction from a downstream end of the suction pipe to the external water passage pipe, and the float switch is disposed on a side perpendicular to an axial direction of the internal water passage pipe.

6. The flush toilet according to claim 5, wherein the discharge trap extends, in a plan view, in a front-back direction from an inlet connected to the bowl to an outlet behind the bowl, and the storage tank main body is disposed in a manner surrounding an upper part of the discharge trap, the pump and the external water passage pipe from both left and right sides and from behind.

7. The flush toilet according to claim 5, wherein the storage tank main body has a left-right asymmetrical shape including a large tank-main body section and a small tank-main body section, the large tank-main body section being a large-capacity side of the storage tank main body that is divided into two at a center in a left-right direction, the small tank-main body section being a small-capacity side of the storage tank main body that is divided into two at the center in the left-right direction, and the collision part, the suction pipe, and the sensing unit of the float switch are each provided inside the large tank-main body section.

8. The flush toilet according to claim 7, wherein the large tank-main body section includes a rear large tank-main body section that is disposed behind the discharge trap, a front large tank-main body section that extends forward from the rear large tank-main body section and that is disposed on one of left and right sides of the discharge trap, and a lower large tank-main body section that extends downward from the rear large tank-main body section, the small tank-main body section includes a rear small tank-main body section that is disposed behind the discharge trap, and a front small tank-main body section that extends forward from the rear small tank-main body section and that is disposed on another one of the left and right sides of the discharge trap, a front end of the front large tank-main body section is disposed more forward than a front end of the front small tank-main body section, a bottom surface of the lower large tank-main body section is located at a position that is lower than a bottom surface of each of the rear small tank-main body section and the front small tank-main body section, and the float switch is a single float switch that is provided at an upper part in the rear large tank-main body section.

* * * * *